US009732486B1

(12) United States Patent
Reed

(10) Patent No.: US 9,732,486 B1
(45) Date of Patent: Aug. 15, 2017

(54) ANIMAL WASTE COLLECTION ASSEMBLY

(71) Applicant: Burnell Reed, Portland, OR (US)

(72) Inventor: Burnell Reed, Portland, OR (US)

( * ) Notice: Subject to any disclaimer, the term of this patent is extended or adjusted under 35 U.S.C. 154(b) by 0 days.

(21) Appl. No.: 15/161,487

(22) Filed: May 23, 2016

(51) Int. Cl.
*A01K 29/00* (2006.01)
*E01H 1/00* (2006.01)

(52) U.S. Cl.
CPC ..... *E01H 1/006* (2013.01)

(58) Field of Classification Search
CPC ..... E01H 1/006; E01H 1/1206; E01H 2001/1293; E01H 2001/128; E01H 2001/1226; A01K 23/005; A47L 13/52
USPC ..... 294/1.4, 1.3, 1.5, 177
See application file for complete search history.

(56) References Cited

U.S. PATENT DOCUMENTS 1,762,347 A * 6/1930 Peebles ..... F24B 15/06 294/177
4,299,419 A * 11/1981 Kalan ..... F24B 1/1915 294/177
4,478,448 A 10/1984 Albert
4,709,440 A 12/1987 Conelly
4,765,666 A 8/1988 Parks
4,966,400 A 10/1990 Hull et al.
5,503,442 A * 4/1996 Lee ..... E01H 1/1206 294/1.4
5,513,883 A * 5/1996 Segla ..... F23J 1/04 294/177
5,562,319 A * 10/1996 Kohler ..... E01H 1/1206 294/1.4
6,135,520 A 10/2000 Miller et al.
8,201,863 B1 6/2012 Konovalov
D663,906 S 7/2012 Pallant
2002/0038957 A1* 4/2002 Harrison ..... E01H 1/008 294/1.4
2012/0080894 A1* 4/2012 Williamson ..... A01K 23/005 294/1.4
2012/0274089 A1* 11/2012 Green ..... E01H 1/1206 294/1.4
2015/0089846 A1 4/2015 Wooley

FOREIGN PATENT DOCUMENTS

DE 2455113 A1 * 5/1976 ..... E01H 1/006
FR 2263681 A1 * 10/1975 ..... A01K 23/005
FR 2631212 A1 * 11/1989 ..... E01H 1/006
WO WO2011026175 3/2011

* cited by examiner

*Primary Examiner* — Gabriela Puig

(57) ABSTRACT

An animal waste collection assembly includes a box that has a first half that is hingedly coupled to the second half. The first half is positioned in an open position and the box may collect animal waste. A pair of wheels is provided and each of the wheels is coupled to the box. Thus, the box may be rolled along a support surface. A handle is coupled to the box and the handle may be manipulated. An actuator is coupled to the handle and the actuator may be manipulated. The actuator is mechanically coupled to the first half such that the actuator selectively urges the first half into the open position wherein the second half is configured to receive animal waste.

6 Claims, 5 Drawing Sheets

ANIMAL WASTE COLLECTION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to waste collection devices and more particularly pertains to a new waste collection device for collecting animal waste.

BRIEF SUMMARY OF THE INVENTION

An embodiment of the disclosure meets the needs presented above by generally comprising a box that has a first half that is hingedly coupled to the second half. The first half is positioned in an open position and the box may collect animal waste. A pair of wheels is provided and each of the wheels is coupled to the box. Thus, the box may be rolled along a support surface. A handle is coupled to the box and the handle may be manipulated. An actuator is coupled to the handle and the actuator may be manipulated. The actuator is mechanically coupled to the first half such that the actuator selectively urges the first half into the open position wherein the second half is configured to receive animal waste.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
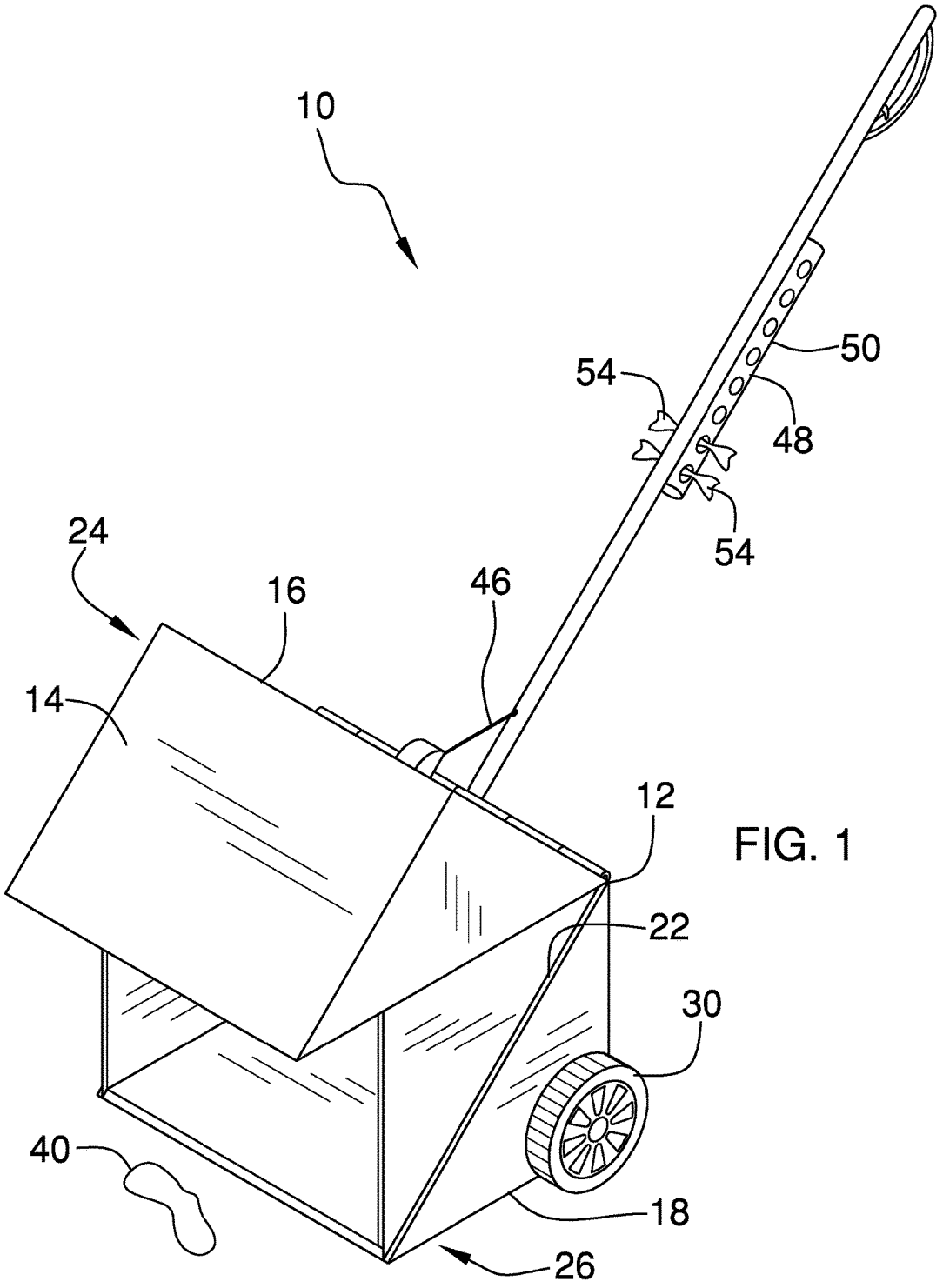
FIG. 1 is a front perspective view of an animal waste collection assembly according to an embodiment of the disclosure.
Figure 2:
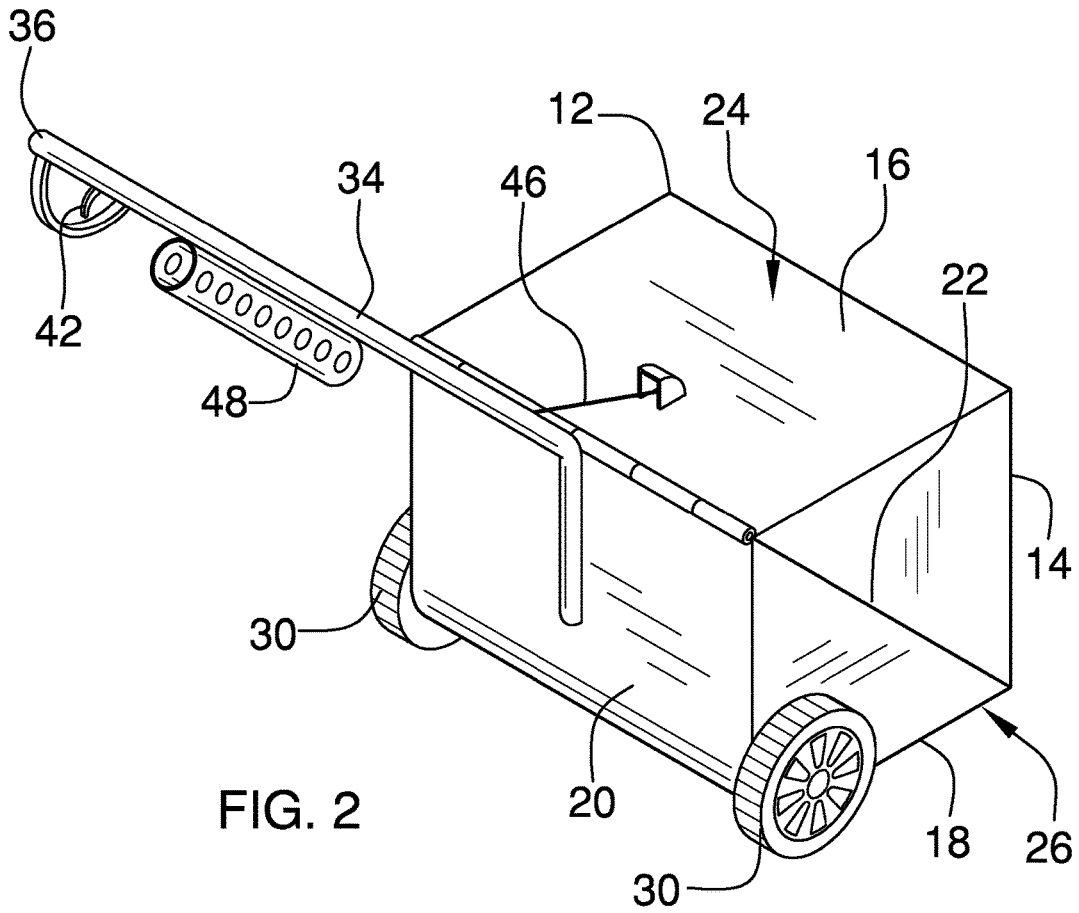
FIG. 2 is a back perspective view of an embodiment of the disclosure.
Figure 3:
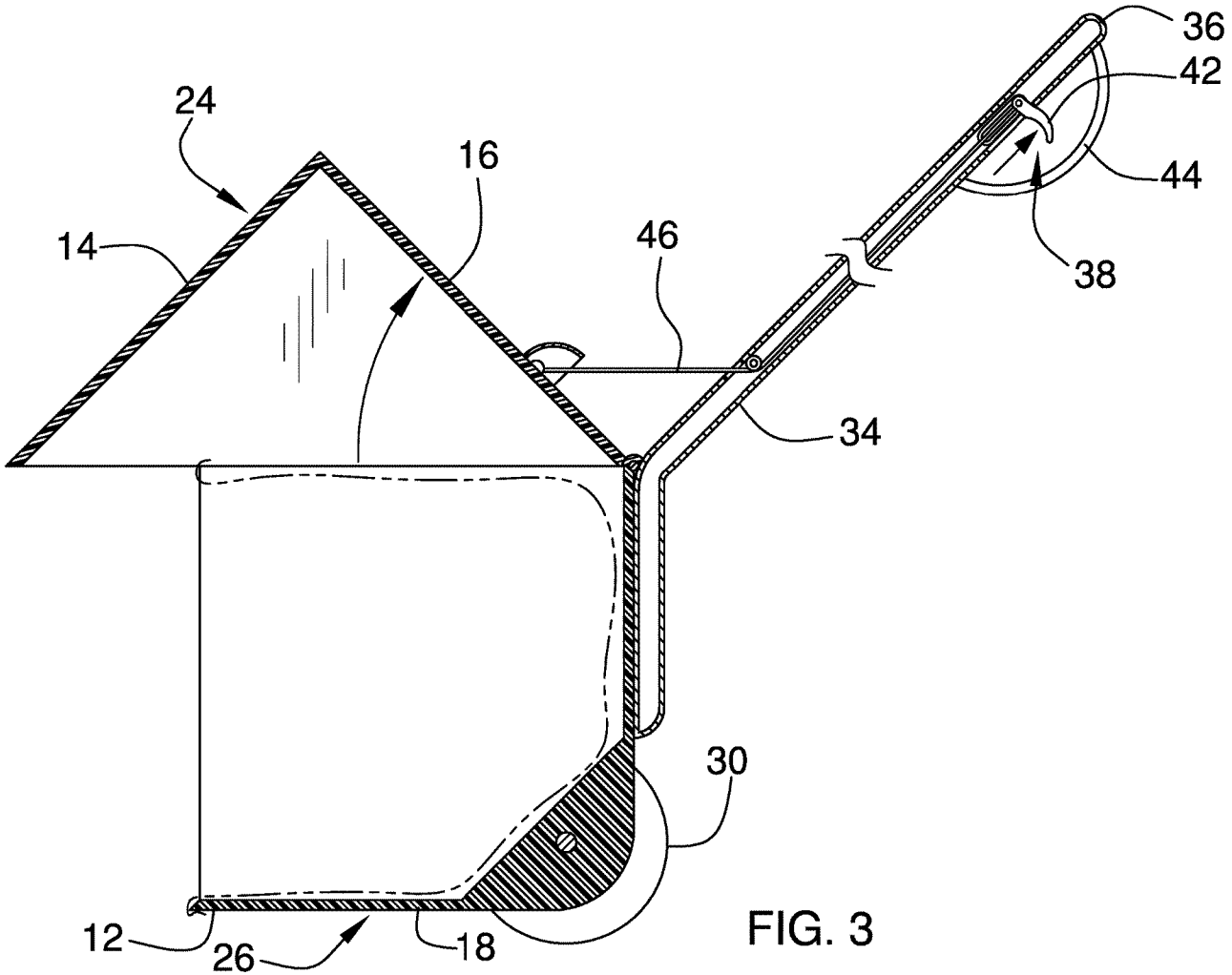
FIG. 3 is a cross sectional view taken along line 3-3 of FIG. 1 of an embodiment of the disclosure.
Figure 4:
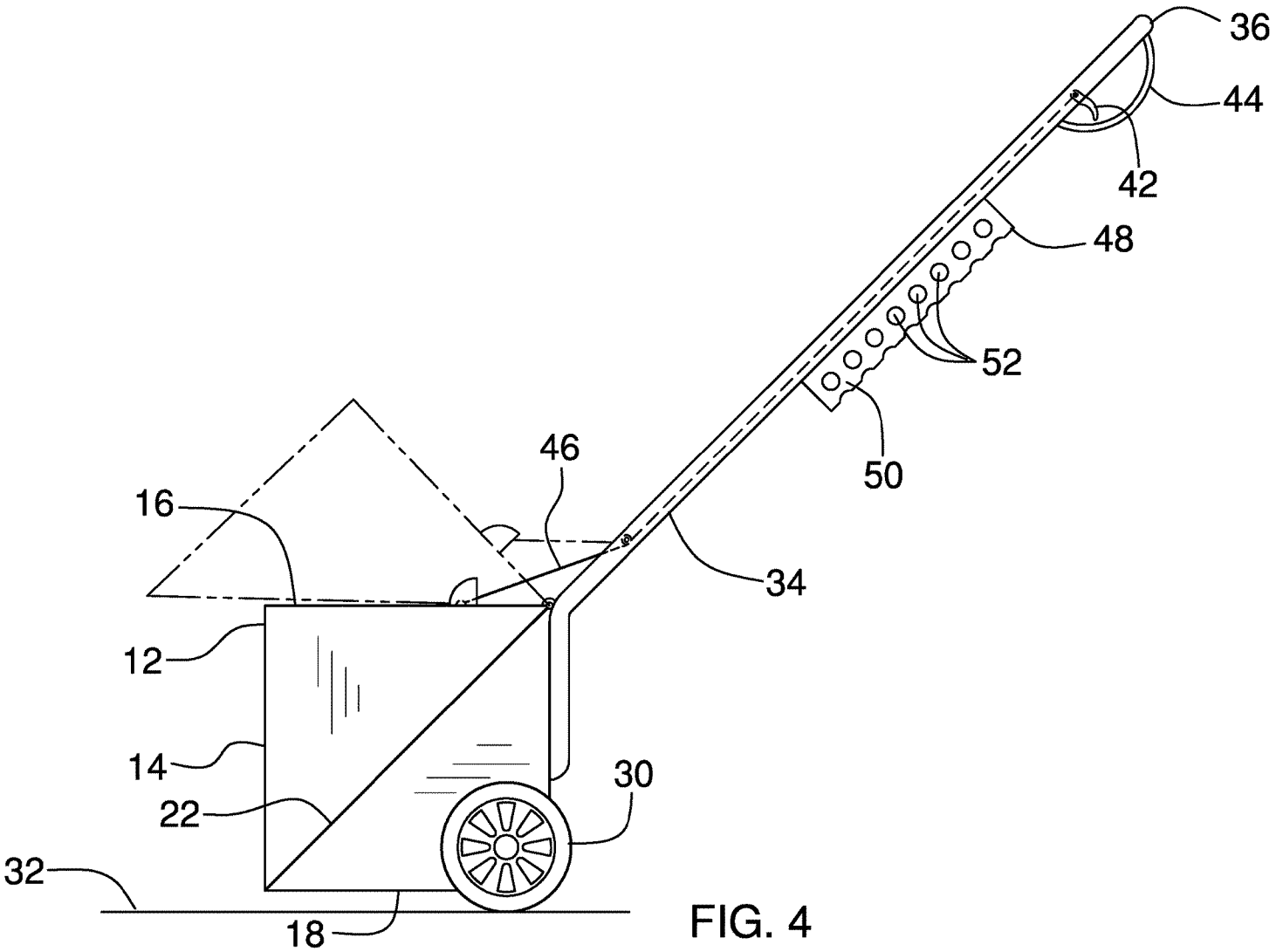
FIG. 4 is a left side view of an embodiment of the disclosure.
Figure 5:
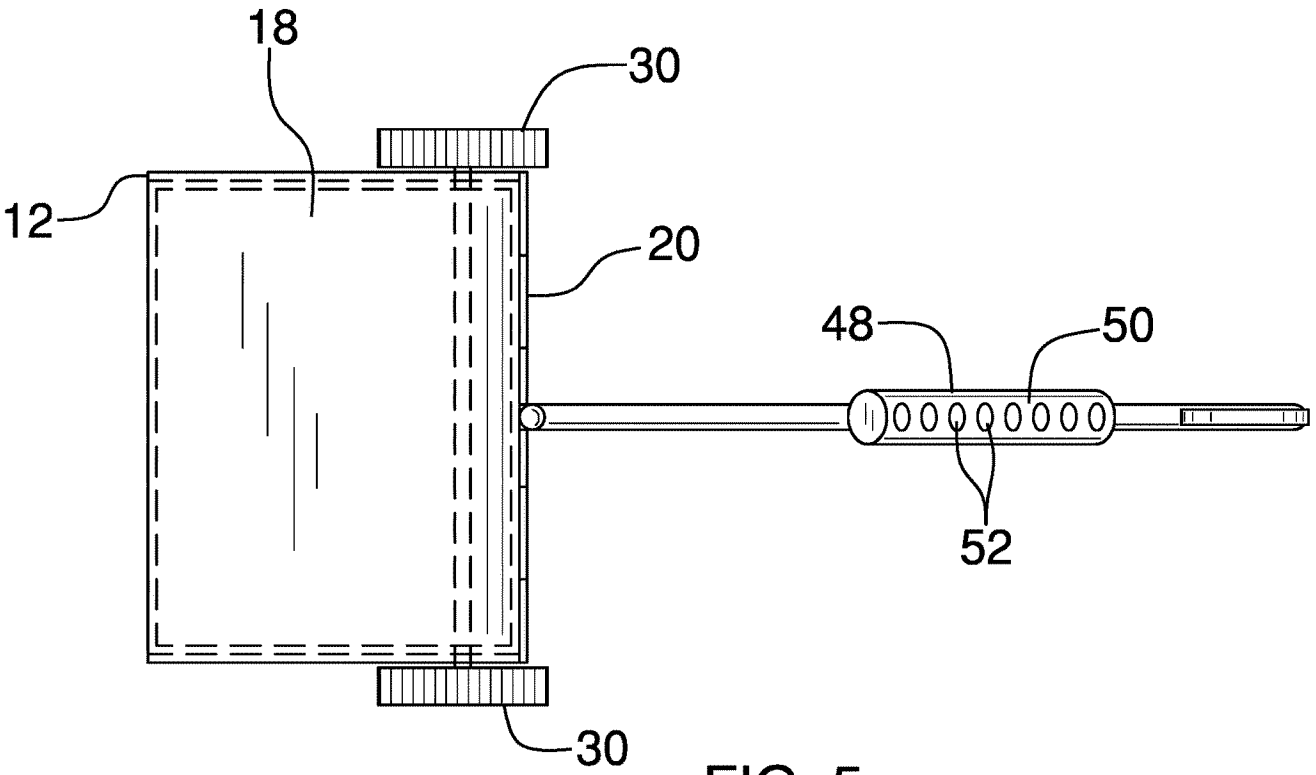
FIG. 5 is a bottom view of an embodiment of the disclosure.

With reference now to the drawings, and in particular to FIGS. 1 through 5 thereof, a new waste collection device embodying the principles and concepts of an embodiment of the disclosure and generally designated by the reference numeral 10 will be described.

As best illustrated in FIGS. 1 through 5, the animal waste collection assembly 10 generally comprises a box 12 that has a front side 14, a top side 16, a bottom side 18 and a back side 20. The box 12 has a cut 22 such that the box 12 is diagonally bisected between the top side 16 and the bottom side 18. The cut 22 defines a first half 24 and a second half 26, and the second half 26 is substantially hollow. The first half 24 is hingedly coupled to the second half 26 along an intersection of the back side 20 and the top side 16. The first half 24 is positioned in a closed position having the first half 24 abutting the second half 26. The first half 24 is positioned in an open position thereby exposing an interior of the second half 26.

A pair of wheels 30 is provided. Each of the wheels 30 is coupled to the box 12 and the box 12 may be rolled along a support surface 32. The support surface 32 may be ground. Each of the wheels 30 is oppositionally positioned at an intersection of the back side 28 and the bottom side 18.

A handle 34 is coupled to the box 12 and the handle 34 may be manipulated. The handle 34 is coupled to the back side 28. The handle 34 extends upwardly and rearwardly from the top side 16. The handle 34 has a distal end 36 with respect to the box 12.

An actuator 38 is coupled to the handle 34 and the actuator 38 may be manipulated. The actuator 38 is mechanically coupled to the first half 24. The actuator 38 selectively urges the first half 24 into the open position. Thus, the second half 26 may receive animal waste 40. The animal waste 40 may comprise dog feces or the like.

The actuator 38 comprises a trigger 42 that is movably coupled to the handle 34 and the trigger 42 may be manipulated. The trigger 42 is positioned proximate the distal end 36 of the handle 34. A guard 44 is coupled to the handle 34 and the guard 44 is spaced from the trigger 42. The guard 44 inhibits the trigger 42 from being inadvertently manipulated.

A cable 46 is coupled between the trigger 42 and the top side 16 corresponding to the first half 24. The cable 46 is positioned within the handle 34. The cable 46 extends outwardly from the handle 34 proximate the box 12.

A sleeve 48 is coupled to the handle 34 and the sleeve 48 is oriented to be coextensive with the handle 34. The sleeve 48 has an outer wall 50 and the outer wall 50 has a plurality of apertures 52 extending therethrough. Each of the apertures 52 may insertably receive a bag 54 for storage. Thus, the bag 54 in each of the apertures 52 may be available for bagging the animal waste 40.

In use, the handle 34 is manipulated and the box 12 is rolled along the support surface 32. The trigger 42 is manipulated and the first half 24 is positioned in the open position. The box 12 is maneuvered to capture to animal waste 40 in the second half 26. The trigger 42 is released and the first half 24 is positioned in the closed position. The box 12 is urged around a yard or the like to collect animal waste 40 from a pet or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An animal waste collection assembly comprising:

a box having a first half being hingedly coupled to a second half, said first half being positioned in an open position wherein said box is configured to collect animal waste;

a pair of wheels, each of said wheels being coupled to said box wherein said box is configured to be rolled along a support surface;

a handle being coupled to said box wherein said handle is configured to be manipulated;

an actuator being coupled to said handle wherein said actuator is configured to be manipulated, said actuator being mechanically coupled to said first half such that said actuator selectively urges said first half into said open position wherein said second half is configured to receive animal waste;

and wherein box having a front side, a top side a bottom side and a back side, said box having a cut such that said box is diagonally bisected between said top side and said bottom side to define said first half and said second half, said second half being substantially hollow, said first half being hingedly coupled to said second half along an intersection of said back side and said top side, said first half being positioned in a closed position having said first half abutting said second half, said first half being positioned in an open position having thereby exposing an interior of said second half.

2. The assembly according to claim 1, wherein said handle is coupled to said back side, said handle extending upwardly and rearwardly from said top side, said handle having a distal end with respect to said box.

3. The assembly according to claim 1, wherein said actuator comprises a trigger being movably coupled to said handle wherein said trigger is configured to be manipulated, said trigger being positioned proximate said distal end of said handle.

4. The assembly according to claim 3, further comprising a guard being coupled to said handle, said guard being spaced from said trigger.

5. The assembly according to claim 3, further comprising a cable being coupled between said trigger and said top side corresponding to said first half, said cable being positioned within said handle, said cable extending outwardly from said handle proximate said box.

6. An animal waste collection assembly comprising:

a box having a front side, a top side a bottom side and a back side, said box having a cut such that said box is diagonally bisected between said top side and said bottom side to define a first half and a second half, said second half being substantially hollow, said first half being hingedly coupled to said second half along an intersection of said back side and said top side, said first half being positioned in a closed position having said first half abutting said second half, said first half being positioned in an open position having thereby exposing an interior of said second half;

a pair of wheels, each of said wheels being coupled to said box wherein said box is configured to be rolled along a support surface, each of said wheels being oppositionally positioned at an intersection of said back side and said bottom side;

a handle being coupled to said box wherein said handle is configured to be manipulated, said handle being coupled to said back side, said handle extending upwardly and rearwardly from said top side, said handle having a distal end with respect to said box; and an actuator being coupled to said handle wherein said actuator is configured to be manipulated, said actuator being mechanically coupled to said first half such that said actuator selectively urges said first half into said open position wherein said second half is configured to receive animal waste, said actuator comprising:

a trigger being movably coupled to said handle wherein said trigger is configured to be manipulated, said trigger being positioned proximate said distal end of said handle, a guard being coupled to said handle, said guard being spaced from said trigger, and a cable being coupled between said trigger and said top side corresponding to said first half, said cable being positioned within said handle, said cable extending outwardly from said handle proximate said box.

* * * * *